US007373861B2

(12) United States Patent
Hsieh

(10) Patent No.: US 7,373,861 B2
(45) Date of Patent: May 20, 2008

(54) PIVOTING ASSEMBLY OF A HAND TOOL

(76) Inventor: Chih-Ching Hsieh, 5F.- 2, No. 181, Sec. 2, Mei Tsun Rd., South District, Taichung City (TW)

( * ) Notice: Subject to any disclaimer, the term of this patent is extended or adjusted under 35 U.S.C. 154(b) by 0 days.

(21) Appl. No.: 11/332,343

(22) Filed: Jan. 17, 2006

(65) Prior Publication Data

US 2007/0163403 A1 Jul. 19, 2007

(51) Int. Cl.
*B25B 23/16* (2006.01)

(52) U.S. Cl. ..... 81/177.9; 403/93; 403/97

(58) Field of Classification Search .... 81/177.7–177.9; 403/93, 97

See application file for complete search history.

(56) References Cited

U.S. PATENT DOCUMENTS 2,420,132 A * 5/1947 Gryniuck ..... 81/58.3
5,419,221 A * 5/1995 Cole ..... 81/60
5,941,141 A * 8/1999 Whitley ..... 81/63.1
6,032,555 A * 3/2000 Whitley ..... 81/63.1
6,101,907 A * 8/2000 McGovern et al. ..... 81/177.8
6,216,565 B1 * 4/2001 McCann ..... 81/177.8
6,928,904 B2 * 8/2005 Hsien ..... 81/60

* cited by examiner

*Primary Examiner*—D S Meislin

(57) ABSTRACT

A pivoting assembly of a hand tool comprising a tool body, the tool body including a driving portion, a handle and a pivotal portion; the pivotal portion having a first pivoted end and a second pivoted end; the first pivoted end being installed to one of the handle and driving portion; and the second pivoted end being installed to the other one of the handle and driving portion so that an angle between the handle and driving portion is adjustable. The first pivoted end is formed with a buckling hole; a tooth portion is formed in the buckling hole; the second pivoted end is formed with a post; the post is axially moveable with respect to the tooth portion of the buckling hole; and a bottom of the post is formed with teeth with respect to the tooth portion of the buckling hole.

1 Claim, 8 Drawing Sheets

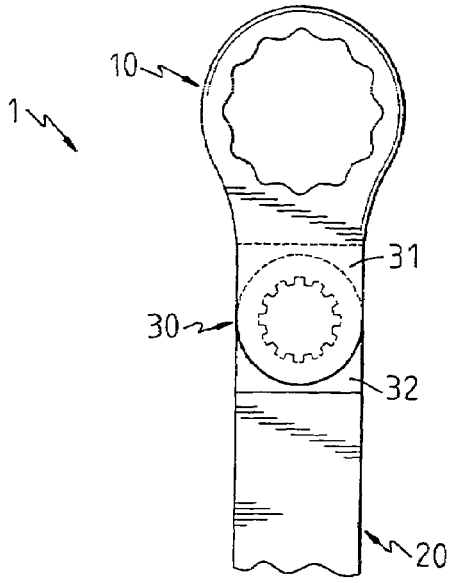
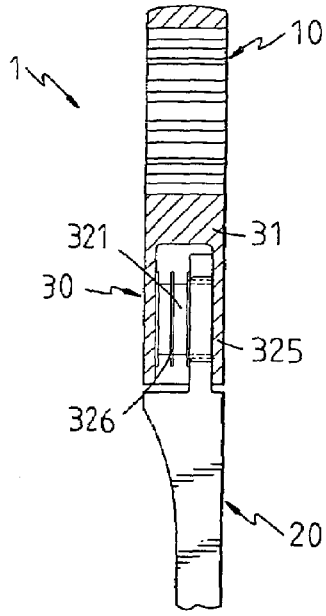
FIG. 11 FIG. 12
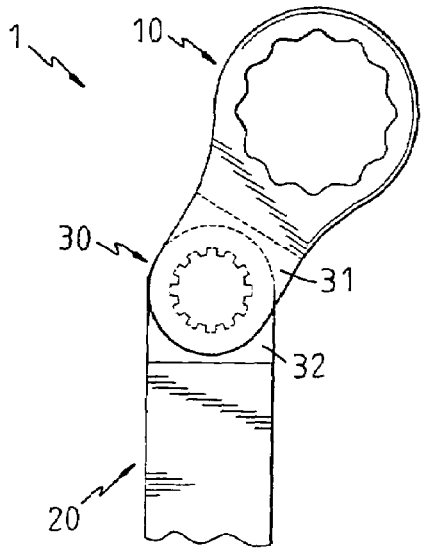
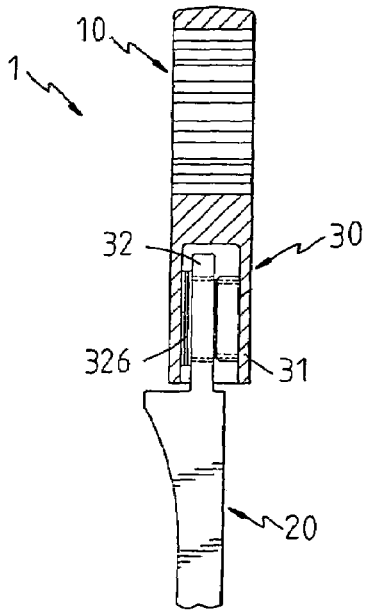
FIG. 13 FIG. 14

PIVOTING ASSEMBLY OF A HAND TOOL

FIELD OF THE INVENTION

The present invention relates to hand tools, and in particular to a pivoting assembly of a hand tool by which a driving portion of a hand tool is pivotally rotated with respect to the handle of the hand tool.

BACKGROUND OF THE INVENTION

In the prior hand tools, such as spanners, the tool generally has driving portion and a handle. The driving portion is engaged to a screw means for driving the screw means to rotate repeatedly. However the driving portion is retained to the handle, that is, the driving portion cannot rotate with respect to the handle so that if the work environment is not suitable for locating the spanner. The operator will feel uneasy in operation and the operation is inefficiency.

There are some portions which aim at to an adjustable spanner for improving above mentioned defects, such as U.S. Pat. Nos. 5,419,221, 6,928,904 and Taiwan Patent No. 542053. In these prior arts, a pivotal portion is installed between a driving portion and a handle so that the driving portion is rotatable with respect to the handle. However the pivotal portion has a complicated structure and it is difficult to position the pivotal portion. In operation, the pivotal portion easily slides away when a screwing means is rotated. Moreover when the driving portion is engaged to the handle, for installing a buckling portion, the thickness of the driving portion and the handle are twice of a general spanner. Thereby the spanner cannot be inserted into a narrow space. Moreover a larger space is necessary for storing the spanner. Thereby it is impractical.

However the prior art has the following disadvantages. Firstly, the pivotal portion between the driving portion and the handle is too large to be stored. Thereby the structure of the pivotal portion is complicated so that the cost is high and the manufacturing efficiency is low. Furthermore, the operations for buckling and rotating the pivotal portion are inconvenient. The pivotal portion easily slides away in driving a screw means.

SUMMARY OF THE INVENTION

Accordingly, the primary object of the present invention is to provide a pivoting assembly of a hand tool by which a driving portion of a hand tool is pivotally rotated with respect to the handle of the hand tool so as to improve the defects in the prior art, such as complicated structure, greater thickness and difficult in assembly and manufacturing.

To achieve above objects, the present invention provides a pivoting assembly of a hand tool which comprises a tool body, the tool body including a driving portion, a handle and a pivotal portion; the pivotal portion having a first pivoted end and a second pivoted end; the first pivoted end being installed to one of the handle and driving portion; and the second pivoted end being installed to the other one of the handle and driving portion so that an angle between the handle and driving portion are adjustable. The first pivoted end is formed with a buckling hole; a tooth portion is formed in the buckling hole; the second pivoted end is formed with a post. The post is axially moveable with respect to the tooth portion of the buckling hole; and a bottom of the post is formed with teeth with respect to the tooth portion of the buckling hole; thereby, when a bottom of the post is pressed so that the post inserts into the buckling hole. The teeth of the post will engage to the tooth portion of the buckling hole so that the driving portion is retained to the handle for screwing an object.

The various objects and advantages of the present invention will be more readily understood from the following detailed description when read in conjunction with the appended drawing.

BRIEF DESCRIPTION OF THE DRAWINGS

FIG. 11 is a partial perspective view about the pivoting assembly of a hand tool of the present invention.

FIG. 12 is a partial lateral view of the pivoting assembly of a hand tool of the present invention.

FIG. 13 is a partial perspective view about the second embodiment of the present invention.

FIG. 14 is a partial lateral view about the adjustment in the second embodiment of the pivoting assembly of a hand tool according to the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 4, the structure of the present invention is illustrated. The present invention has a tool body 1. The tool body 1 has the following elements.

Figure 1:
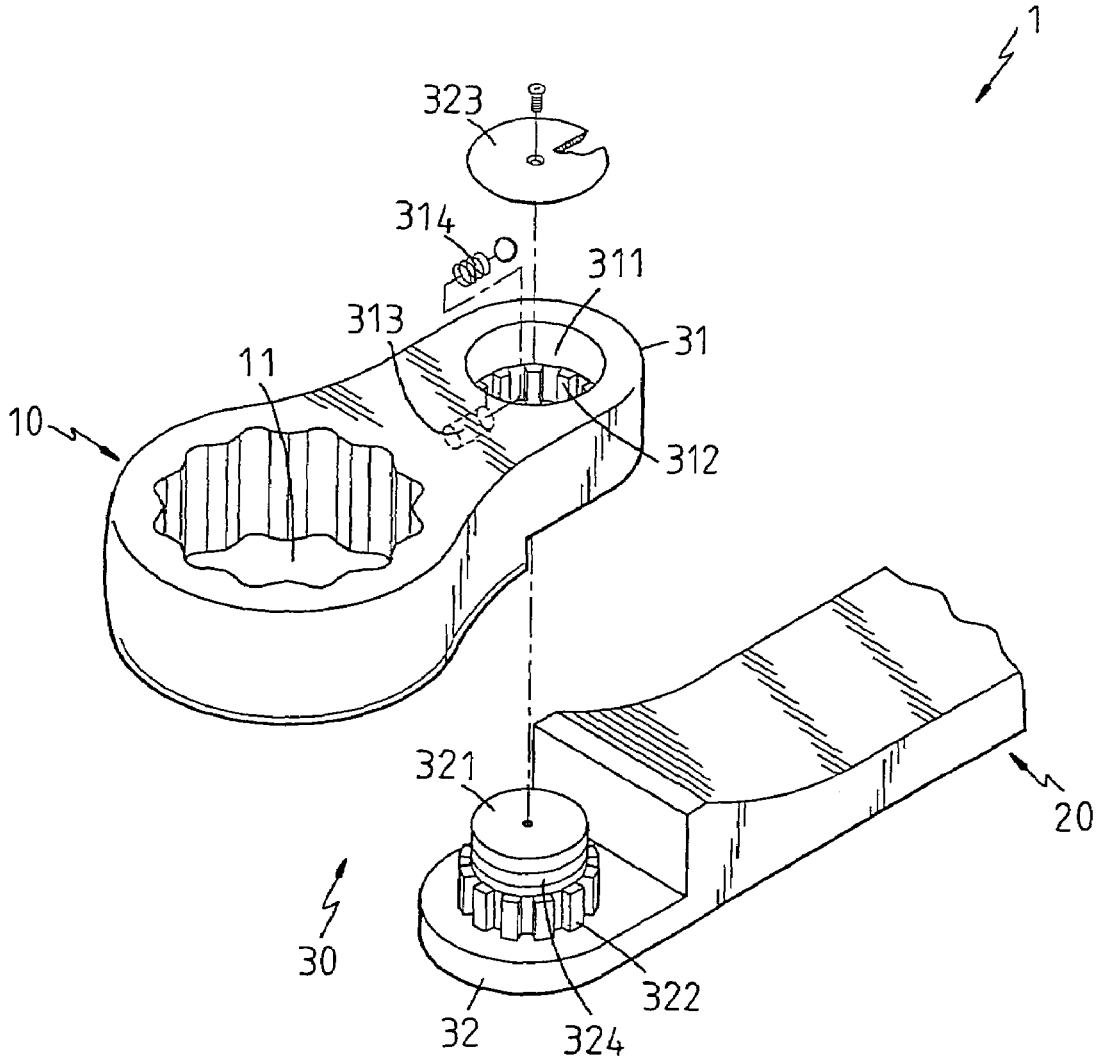
FIG. 1 is an exploded perspective view of the pivoting assembly of a hand tool of the present invention.
Figure 2:
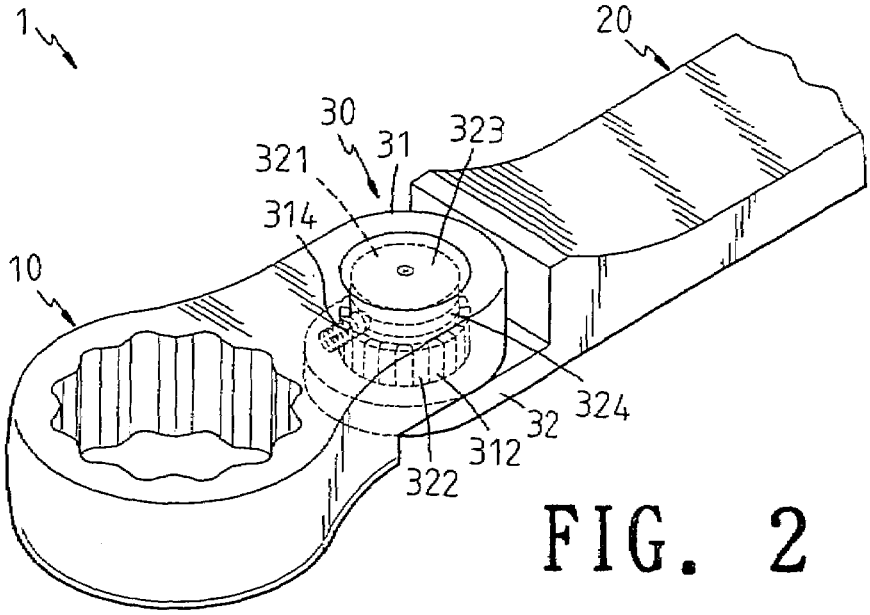
FIG. 2 is a perspective view of the pivoting assembly of a hand tool of the present invention.
Figure 3:
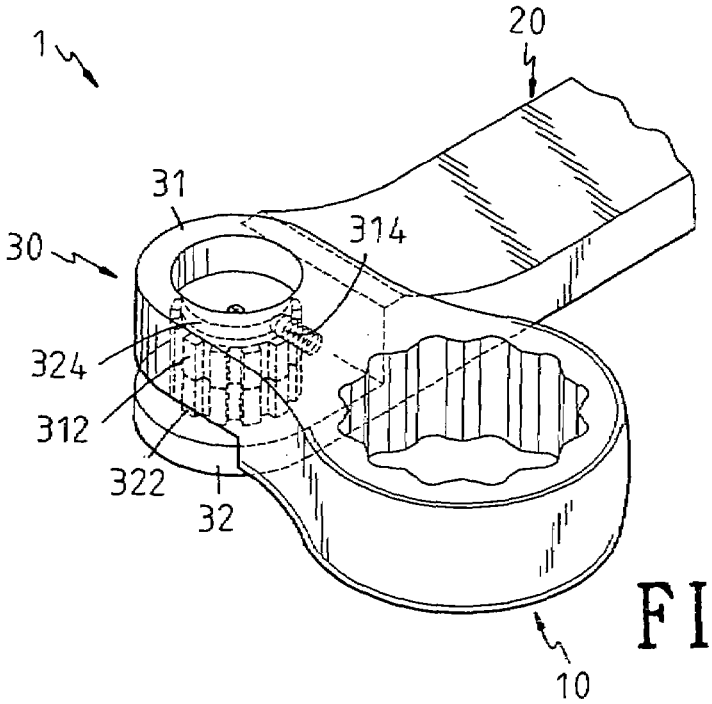
FIG. 3 is a perspective view of the driving portion of the pivoting assembly of a hand tool of the present invention.
Figure 4:
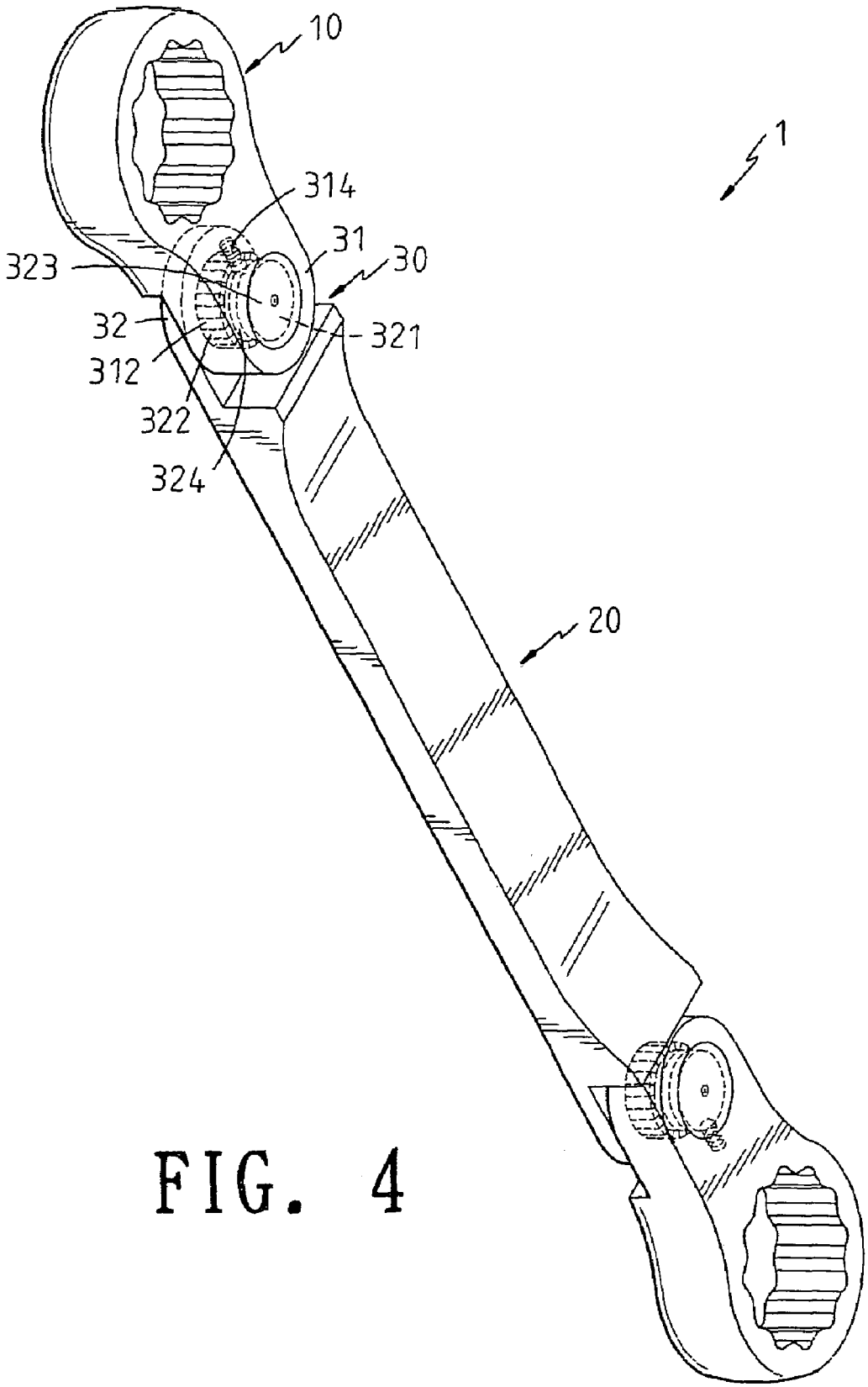
FIG. 4 is a perspective view showing the outlook of the pivoting assembly of a hand tool of the present invention.
Figure 5:
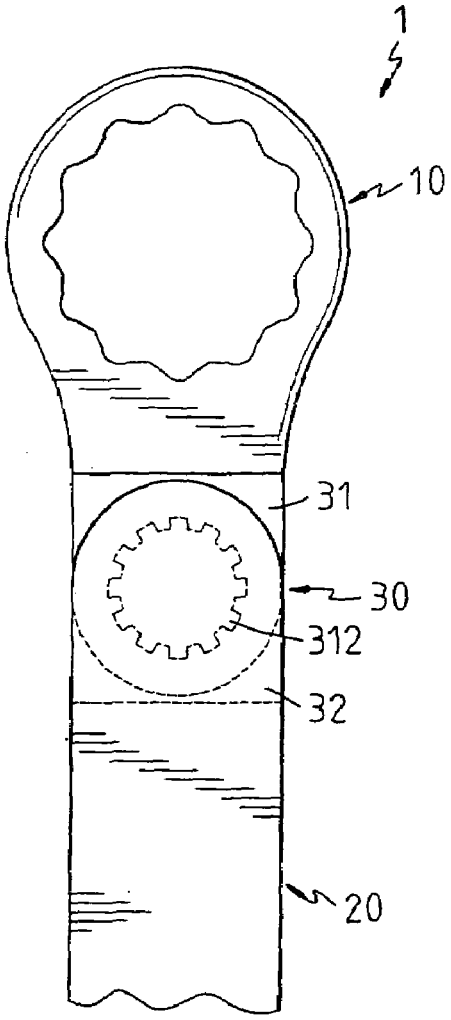
FIG. 5 is a partial perspective view of the pivoting assembly of a hand tool of the present invention.
Figure 6:
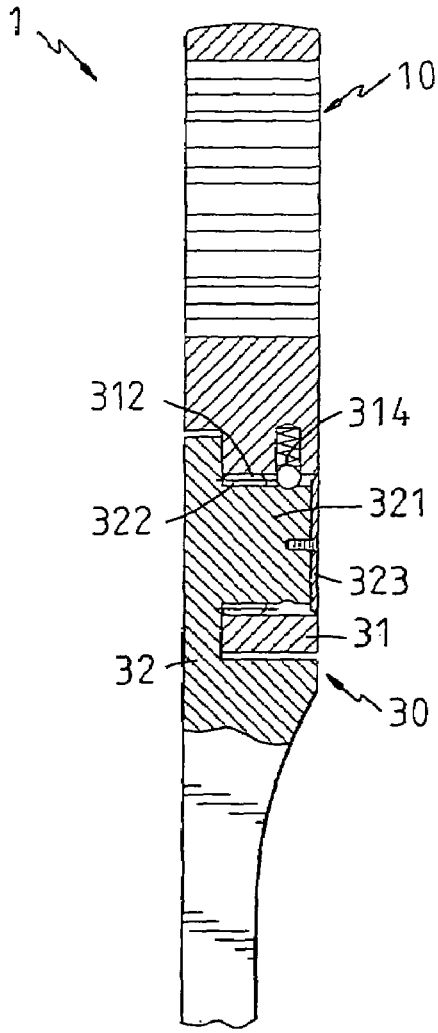
FIG. 6 is a partial lateral view of the pivoting assembly of a hand tool of the present invention.
Figure 7:
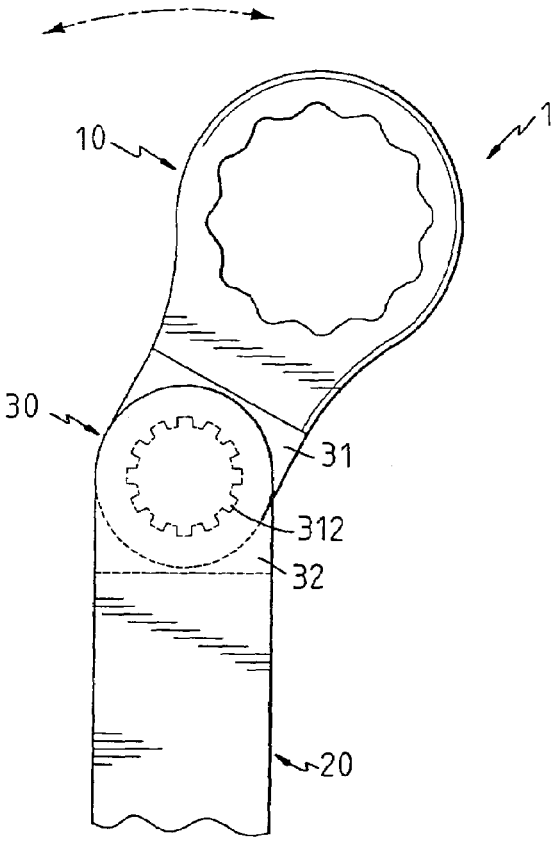
FIG. 7 is a partial perspective view of the adjustment of the pivoting assembly of a hand tool of the present invention.
Figure 8:
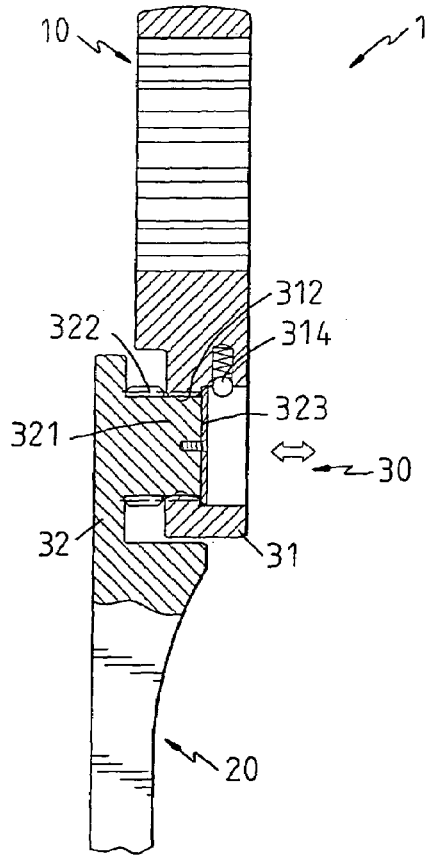
FIG. 8 is a lateral cross sectional view about the pivoting assembly of a hand tool of the present invention.
Figure 9:
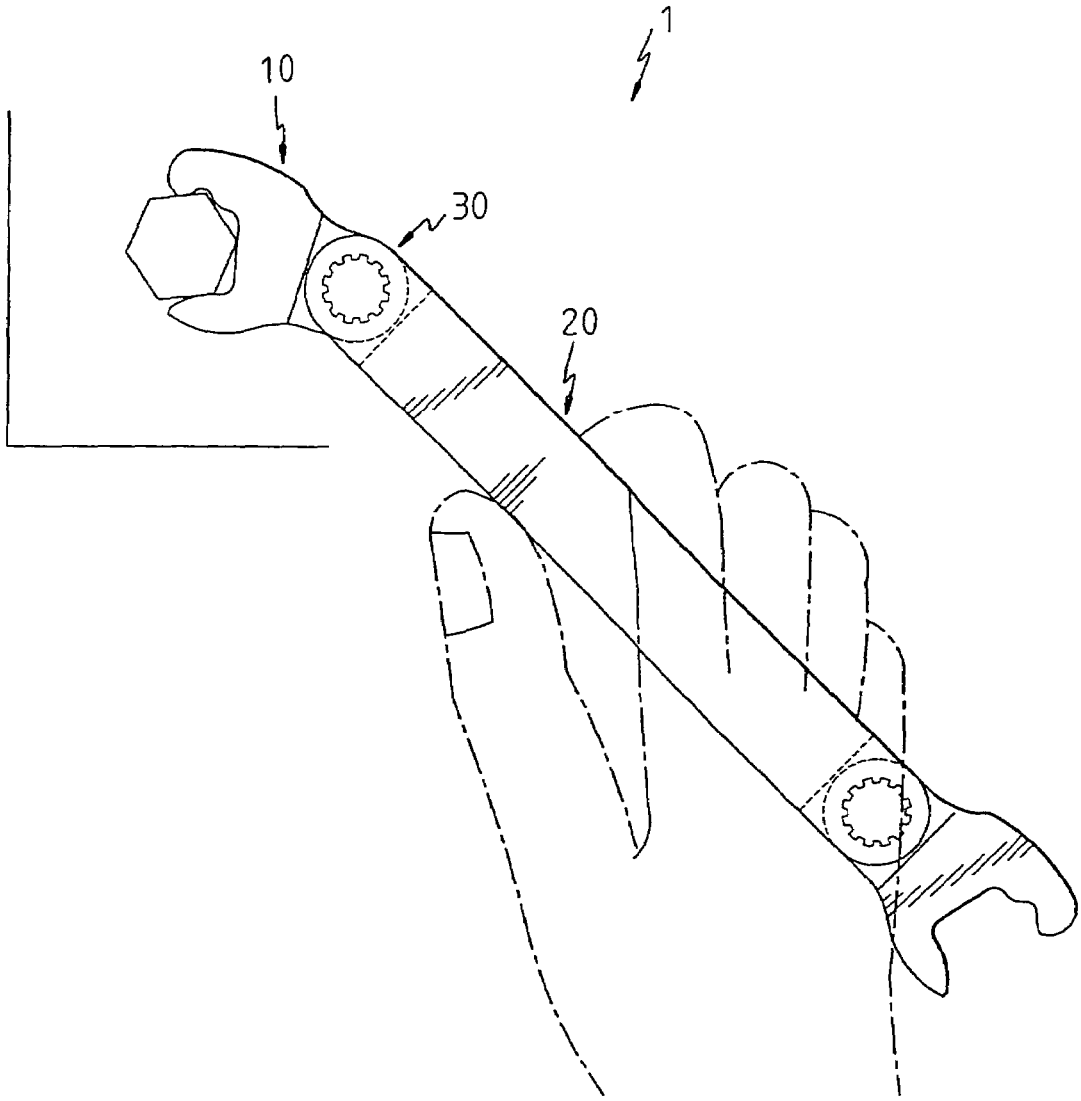
FIG. 9 is a schematic view about the use of the pivoting assembly of a hand tool of the present invention.
Figure 10:
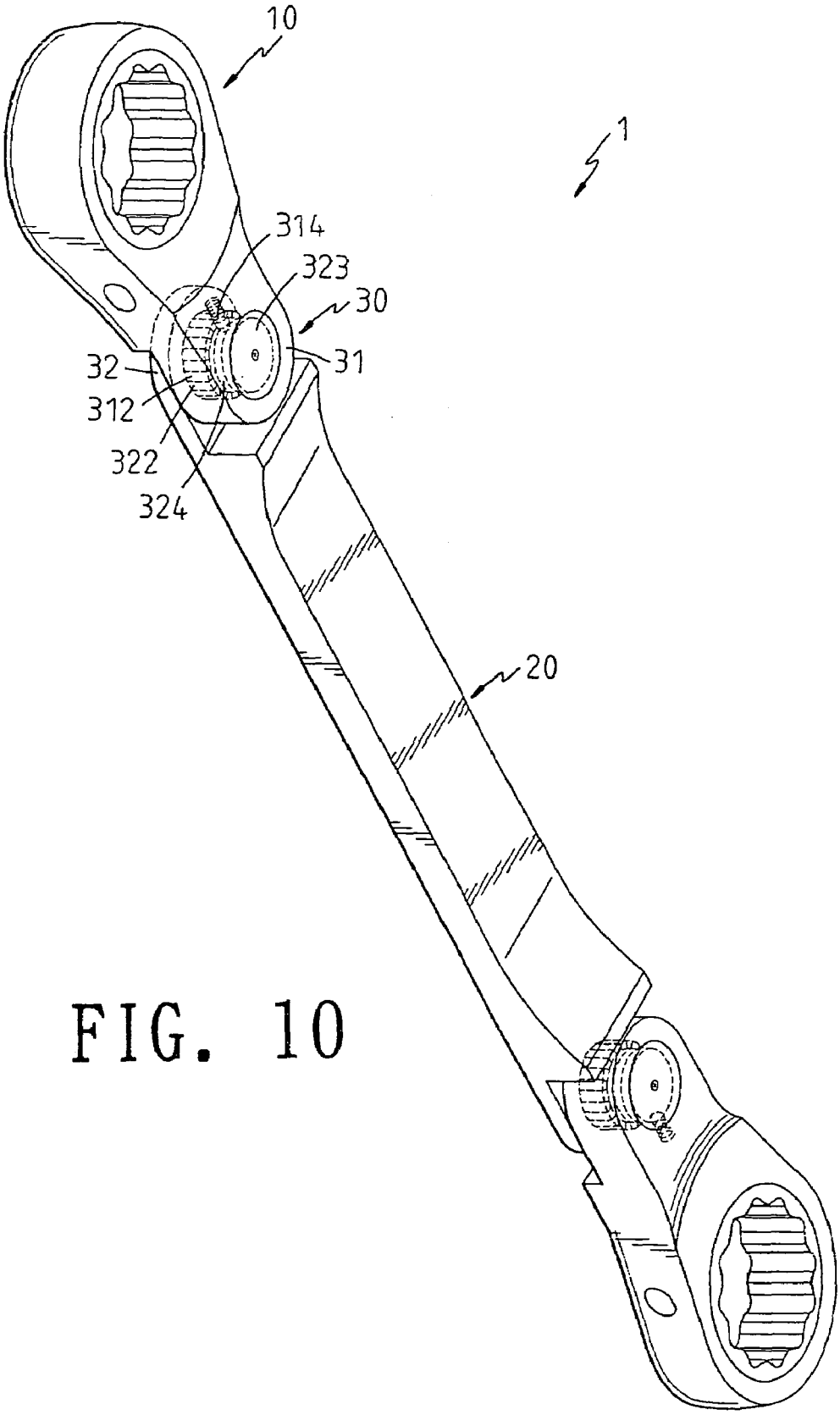
FIG. 10 is a perspective view about another embodiment of the present invention.

A driving portion 10 has a front end which is formed with a driving opening 11 for engaging with a screw element. The form of the driving opening 11 can have various forms, such as those illustrated in FIGS. 9, 10 and 11. Those the driving portion 10 illustrated in the drawing is not used to confine the scope of the present invention.

A handle 20 is as a force applied portion. With the driving opening 11 of the driving portion 10, the tool body can be used to drive a screw unit for assembly or detaching an object. Above mentioned is known in the prior art and thus the detail will not be further described herein.

A pivotal portion 30 serves for pivotally installing the driving portion 10 to the handle 20 so that the driving portion 10 is rotatable with respect to the handle 20. The pivotal portion 30 has a first pivoted end 31 at an end of the driving portion 10 opposite to the end having the driving opening 11. A second pivoted end 32 is installed at one end of the handle 20. The first pivoted end 31 and second pivoted end 32 are pivoted to each other. The first pivoted end 31 has a buckling hole 311. An axis of the buckling hole 311 is parallel to the axis of the driving opening 11. A bottom of the buckling hole 311 near the second pivoted end 32 has a tooth portion 312. An interior of the buckling hole 311 without the buckling hole 311 is formed with a receiving space 313 for receiving a buckling unit 314 formed by a spring and a steel ball. The second pivoted end 32 is installed with a post 321. An axis of the post 321 is parallel to the axis of the buckling hole 311 and can be inserted into the buckling hole 311. A bottom of the post 321, is annularly installed with teeth 322. The teeth 322 is engageable to the tooth portion 312 of the first pivoted end 31. A top of the post 321 is installed with a positioning sheet 323 for confining the post 321 within the buckling hole 311 of the first pivoted end 31. The first pivoted end 31 and the second pivoted end 32 are combined and the post 321 is formed with an annular groove 324 for resisting and positioning the buckling unit 314.

In assembly of the present invention, the buckling unit 314 is installed in the receiving space 313 in the buckling hole 311 of the first pivoted end 31. The post 321 of the second pivoted end 32 is aligned and inserted to the buckling hole 311 of the first pivoted end 31. Then, the positioning sheet 323 is firmly secured to a top of the post 321 of the second pivoted end 32 so that the post 321 is slidable in the buckling hole 311 and the teeth 322 can be engaged to or separated from tooth portion 312 of the first pivoted end 31. Thus, the assembly of the pivotal portion 30, the first pivoted end 31 and second pivoted end 32 is completed.

Referring to FIGS. 5 to 9, when the post 321 of the second pivoted end 32 completely inserts into the buckling hole 311 of the first pivoted end 31, the annular groove 324 of the post 321 will be resisted by the buckling unit 314. The teeth 322 of the post 321 is engaged to the tooth portion 312 of the first pivoted end 31 so that the first pivoted end 31 and second pivoted end 32 of the pivotal portion 30 cannot be used to adjust the angle. If it is necessary to adjust the angle of the driving portion 10, the positioning sheet 323 of the post 321 is used to push the post 321 toward the outside of the buckling hole 311. Moreover the teeth 322 of the post 321 are separated from the tooth portion 312 of the buckling hole 311. Therefore, the driving portion 10 and the handle 20 will not be deadly locked by the pivotal portion 30 so as to be adjusted to have a required angle (referring to FIGS. 7 and 8). If the angle of the driving portion 10 is adjusted, the post 321 of the second pivoted end 32 is pushed toward the buckling hole 311 so that the teeth 322 of the post 321 is engaged to the tooth portion 312 of the buckling hole 311. Thereby a screw means can be rotated conveniently.

Referring to FIGS. 11 to 14, the second embodiment of the present invention is illustrated. Those identical to the first embodiment will not be described herein. Only those different between the two are described. In this the present invention, the first pivoted end 31 of the pivotal portion 30 can be pivoted to one end of the handle 20 and the second pivoted end 32 is pivoted to the driving portion 10. The effect is identical to the first embodiment. The second pivoted end 32 of the pivotal portion 30 is formed with two stoppers 325. The stoppers have holes (not shown) for receiving the post 321. The first pivoted end 31 is inserted into a U shape space of the second pivoted end 32. The post 321 passes through the buckling hole 311 of the first pivoted end 31 so as to confine the first pivoted end 31 to engage to the second pivoted end 32. An elastic unit 326 encloses the post 321. The elastic unit 326 pushes the first pivoted end 31 so that the teeth 322 of the post 321 is engaged to the tooth portion 312 of the buckling hole 311 without external forces applied thereon. If it is desired to adjust the angle of the driving portion 10, as shown in FIGS. 13 and 14, the teeth 322 of the post 321 is separated from the tooth portion 312 of the buckling hole 311 for adjusting the driving portion 10.

In the second embodiment of the present invention, the elastic unit 326 can be installed to another side of the buckling hole 311 of the post 321 and the elastic unit 326 applies a force from another side of the buckling hole 311 of the post 321 so that the teeth 322 of the post 321 is separated from the tooth portion 312 of the buckling hole 311 without external forces applied thereon.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pivoting assembly of a hand tool comprising a tool body, the tool body including a driving portion, a handle and a pivotal portion; the pivotal portion having a first pivoted end and a second pivoted end; the first pivoted end being installed to the driving portion; and the second pivoted end being installed to the handle so that an angle between the handle and driving portion are adjustable;

wherein the first pivoted end is formed with a buckling hole; a tooth portion is formed in the buckling hole; the second pivoted end is formed with a post; the post is axially moveable with respect to the tooth portion of the buckling hole; and a bottom of the post is formed with teeth with respect to the tooth portion of the buckling hole; the teeth being axial arranged and being near a lower side of the post; thereby, when a bottom of the post is pressed so that the post inserts into the buckling hole, the teeth of the post will engage to the tooth portion of the buckling hole so that the driving portion is retained to the handle for screwing an object;

wherein the driving portion is a ring with inner teeth at a periphery of a wall of the ring; and wherein a wall of the buckling hole of the first pivoted end is formed with a recess; and the recess is installed with a buckling unit; and the post is formed with an annular groove; the buckling unit resists against the annular groove so that when the teeth of the post is engaged to the tooth portion of the buckling hole, the buckling unit is retained in the buckling hole; wherein the buckling unit is formed by a steel ball and a spring resisting against the ball and an inner bottom of the recess; and wherein a top end of the post is firmly secured with a positioning sheet for preventing the first pivoted end from separating from the second pivoted end wherein the positioning sheet is locked to the post by using a screw to pass through a center of the positioning sheet and an upper center of the post.

* * * * *